US006367356B1

(12) United States Patent
Stepp

(10) Patent No.: US 6,367,356 B1
(45) Date of Patent: Apr. 9, 2002

(54) TOOL DRIVER DEVICE

(76) Inventor: Wesley Stepp, 1701 Winding Way, Taylors, SC (US) 29687

( * ) Notice: Subject to any disclaimer, the term of this patent is extended or adjusted under 35 U.S.C. 154(b) by 0 days.

(21) Appl. No.: 09/351,046

(22) Filed: Jul. 9, 1999

(51) Int. Cl.[7] ..... B25B 23/16

(52) U.S. Cl. ..... 81/177.2; 81/58.1; 81/90.2; 81/180.1

(58) Field of Search ..... 81/58.1, 90.2, 81/177.2, 180.1

(56) References Cited

U.S. PATENT DOCUMENTS

| | | | | |
|---|---|---|---|---|
| 3,127,798 | A | | 4/1964 | Gol |
| 3,651,720 | A | | 3/1972 | Indyk |
| 4,489,628 | A | | 12/1984 | Nicastro |
| 4,502,365 | A | | 3/1985 | Hacker |
| 4,631,989 | A | | 12/1986 | Trowbridge et al. |
| 4,733,584 | A | | 3/1988 | Karge |
| 4,817,476 | A | | 4/1989 | Karge |
| 4,840,094 | A | | 6/1989 | Macor |
| 5,157,995 | A | | 10/1992 | Nogues |
| 5,499,560 | A | | 3/1996 | Aeschliman |
| 5,507,208 | A | | 4/1996 | Pratt |
| 5,752,418 | A | | 5/1998 | Robins |
| 5,761,973 | A | | 6/1998 | Tung |
| 5,927,161 | A | * | 7/1999 | Clifford et al. |
| 5,943,924 | A | * | 8/1999 | Jarvis |
| 6,038,946 | A | * | 3/2000 | Jackson et al. |

* cited by examiner

*Primary Examiner*—Timothy V. Eley
*Assistant Examiner*—Willie Berry, Jr.
(74) *Attorney, Agent, or Firm*—Oscar A. Towler, III; Nexsen Pruet Jacobs & Pollard, LLC

(57) ABSTRACT

An improved tool driver has improved simplicity, torquing strength, and durability and allows a user to interchangeably use tool bits, such as sockets, from at least two different standard sized sets without changing drivers or requiring adapters.

2 Claims, 2 Drawing Sheets

TOOL DRIVER DEVICE

1. Field of the Invention

This invention relates to hand and power tools, and specifically to tools adapted for use with interchangeable tool bits. More particularly, the invention relates to a simple, strong, and durable driver for such tool bits.

2. Background of the Invention

Tools, whether driven by hand or machine, are used in a vast array of circumstances and environments. Tools are used by the individual consumer for occasional jobs around the house and by professional technicians in commercial and industrial applications such as in repair shops and assembly lines.

For reasons including convenience and economy, many tools are designed to accept interchangeable tool bits such as screwdriver heads and sockets. With this design, a single handle can be used to drive, for example, a slotted Phillips type screwdriver or, with a simple change of bits, a regular blade head. In the case of socket wrenches, a single wrench handle, turned by hand or powered by, for example, compressed air, can be used to tighten or loosen different sized bolts or nuts by selecting the correctly sized socket.

In the case of socket wrenches, it has become the industry standard to offer a limited range of handles or drivers for the sockets. Each handle or driver has a single drive portion, or simply drive, for engaging a set of sockets. The most common sizes for tool drivers for socket wrenches are one-quarter inch (¼", or 6.35 mm), three-eighths inch (⅜", or 9.53 mm), and one-half inch (½", or 12.7 mm).

The tool driver is typically a square-shaped extension from the handle, the length of the side of the square giving the tool its size designation. A common feature of most tool drivers is the provision of a detent on at least one side of the square. The purpose of the detent is to increase the friction of the fit between the tool driver and the tool bit, and may be used to help retain the bit on the driver. The detent may be a simple projection, but is more often in the form of a small metal sphere or ball bearing. The ball bearing partially protrudes through an opening in the driver. The detent is often spring biased outwardly of the driver, and the bias may be releasable to allow a tool bit to easily slide on or off the driver.

The tool driver is operatively connected to a torquing mechanism. In its simplest form for a hand tool, the torquing mechanism may consist only of a solid connection to a handle, the torque needed to turn the bolt being provided by the user. The common ratchet wrench allows a user to manipulate the handle in a reciprocal motion while applying torque in only one direction. Power and machine tools may have more complicated torquing mechanisms.

In a given set of sockets designed for use with one of these drivers, each socket will have an opening complementary in size and shape to the size and shape of the tool driver. The opening may also have an internal ridge or trough to engage a detent on the driver. The tool driver engages the opening, and applying torque to the driver in turn provides torque to the socket. The socket has another opening designed to engage a nut or bolt of given size. This second opening will vary from socket to socket within a set to allow an operator to work with different sized fasteners.

It is frequently necessary, especially in operations such as inspection and repair, to tighten or remove several bolts of varying sizes. While the varying size of sockets in a set make it possible sometimes to simply switch to another socket in the same set, it is often necessary to switch to a socket from another set.

The simplest solution for this need is to maintain handles and/or torquing mechanisms for each standard set. In most commercial and industrial applications, however, a fairly wide variety of handle sizes and types, both hand- and power-driven, must be available to each technician. Requiring one of each size handle to be available to each technician can be expensive, while arranging for technicians to share handles often causes delay in one project while another is being accomplished. Moreover, to switch handles, a technician must frequently leave the work station to obtain the needed handle. While each such action may take only a short while, many of these occurring during a shift creates a significant amount of downtime.

Another attempted solution is to provide drive adapters. A typical drive adaptor has a shaft constructed such that it will engage the tool driver of a wrench, for example, at one end. The other end is shaped as a tool driver and dimensioned either larger or smaller than the driver of the wrench so that it can be used with the sockets of a different sized set. While perhaps not as expensive as a full handle, a need for adapters still requires purchase of additional parts.

An additional problem with the use of adapters is the extra length inevitably added to the tool driver. First, especially where a workspace is particularly confined, the additional length may make it difficult or impossible to properly manipulate the tool. Also, the tightening or loosening operation is less efficient. While there is in theory no loss of torque by adding a length at right angles to the direction of torque, as a practical matter, there is. Wear and tear on the adaptor and/or the bolt or workpiece resulting in a less-than-perfect fit result in the torque being applied out of the plane of the bolt, which greatly decreases the efficiency of the tool. The improper fit itself will also contribute greatly to the wear on both the workpiece and the tool.

Several alternatives have been proposed to eliminate the need for adapters and to provide different tool driver sizes in a single tool. These alternatives involve providing sliding or telescoping arrangements for exposing different sized drivers for use with different standard sets. Incorporating such mechanisms into handles or power tools that must, to be competitive and useful, also incorporate reversible ratcheting mechanisms, releasable detents, and the like greatly increases the complexity and hence cost of such tools. Any contaminants such as dirt, grease, or metal filings pose the potential for making the tool inoperable. The complexity of the tool will make repair difficult, and replacement expensive. Finally, as the tool becomes more complex, the amount of force that can be exerted through the tool, and the expected life of the tool, decrease.

There is thus needed in this art an alternative tool driver that overcomes and avoids the foregoing problems.

SUMMARY OF THE INVENTION

It is an object of the invention to provide a simple, strong, and durable tool driver.

It is also an object of the invention to provide an inexpensive tool driver capable of use with at least two different sets of standard tool bits.

It is a further object of the invention to provide a tool driver adapted to fit at least two different sets of standard tool bits without the need for complex structures or manufacturing techniques.

It is moreover an object of the invention to provide such a tool driver having releasable detents for securing on the driver a tool bit from either of two standard sets.

It is another object of this invention to provide a tool driver capable of driving tool bits from at least two different standard sets, and capable of being used with existing torquing mechanisms and handles.

These and other objects are achieved by providing a tool driver for use with a torquing mechanism, having a shaft of predetermined length, the shaft having a first end and a second end; the first end being operatively connected to the torquing mechanism; the second end having a first drive terminal to the second end and a second drive adjacent the first drive; the first drive having a first cross-sectional dimension whereby it can releasably engage any one of a first set of standard tool bits; and the second drive having a second cross-sectional dimension whereby it can releasably engage any one of a second set of standard tool bits, the second cross-section dimension being different from the first cross-sectional dimension. These and other objects of the invention are also provided by such a tool driver wherein a releasable detent is provided in each drive to aid in releasably engaging the tool bits.

DETAILED DESCRIPTION OF THE INVENTION

While the art of tools and tool-making is one of the oldest, especially for hand tools, the problems alluded to above, and others, are still prevalent. The tool driver of the current invention, although relatively simple in design, overcomes these problems and more without introducing the complexities that debilitate the performance of the driver or increase the costs of manufacturing or use. The current invention can be well understood by reference to the figures.

Figure 1:
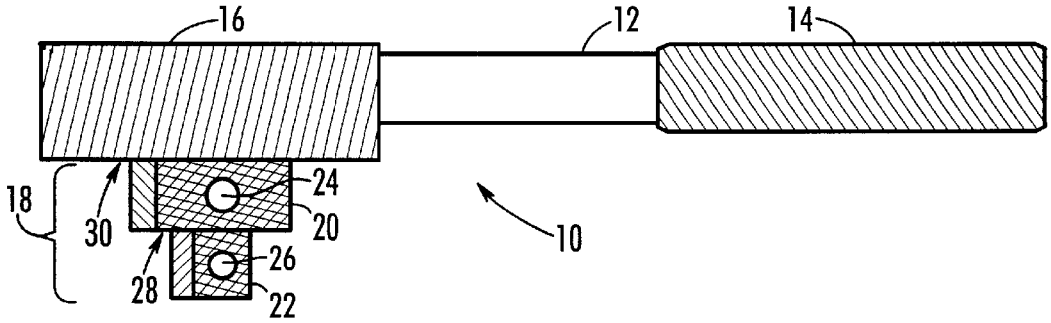
FIG. 1 is a diagrammatic illustration of the tool driver of the current invention for as incorporated into a tool such as a socket wrench.

FIG. 1 shows a tool, in this illustration a wrench 10, incorporating a tool driver 18. This embodiment of the invention is shown incorporated into a wrench having a handle 12 which may be provided with a hand grip 14. Handle 12 is attached to or integral with wrench head 16. Wrench head 16 may be solid or may be provided with a ratchet mechanism, either configuration of which is well-known in the art. Ratchet mechanisms are also well known in the art, and may be fixed in one turning direction or may be reversible to selectively operate in either direction.

Tool driver 18 can be manufactured separately from head 16 or a part of head 16 such as a ratchet wheel (not shown) and attached after manufacture, as by welding, adhesives, or other known fasteners. It may also be manufactured as an integral part of head 16 or of tool 10. Tool driver 18 can be made by any known techniques including casting or stamping.

As shown in FIG. 1, the tool driver 18 has two drives. As used herein, "drive" means that portion of a wrench or other tool that is intended to engage a tool bit. A drive may also be used to engage one end of an adaptor, whether to increase the effective reach of the wrench or for some other reason. In a more general definition, a drive is that portion of a tool that transfers torque from a torqued portion to a portion to be torqued. In the simplest form of a wrench, torque is applied to the handle by the user and is transferred via the drive to the tool bit to exert force on the bolt or other object being manipulated.

For most standard tools, as in socket wrenches, drives are manufactured to have a square cross-section. While this is the most common shape, drives are also available having hexagonal cross-sections. In specialized operations such as robotics used in manufacturing and assembly, a drive may have a specialized shape dictated by the specialized nature of the work, the tool bits, or the manipulator. As used herein, a drive may have any shape designed to be used with interchangeable tool bits.

Referring again to FIG. 1, the tool driver has a first drive 22 at the terminal portion of the driver. In a preferred embodiment of the invention, first drive 22 has a square cross-section. As indicated above, the length of a side of the cross-sectional square may be of any desired size; in a preferred embodiment it is sized to be used with a standard tool bit set such as a three-eighths inch (⅜", or 9.53 mm) set.

Adjacent the first drive 22 is a second drive 20. In a preferred embodiment of the invention, second drive 20 has the same description as first drive 22, with the exception of the dimension of the cross-section. Preferably also having a square cross-section, second drive 20 is dimensioned so as to engage the tool bits of a set different from that engaged by first drive 22. Thus, if first drive 22 is dimensioned to engage the tool bits of a three-eights inch set, second drive 20 is preferably sized to engage the tool bits of a one-half inch or three-quarter inch (¾", or 19.1 mm) set.

In a preferred embodiment of the invention, drives 20 and 22 are formed as an integral piece. This construction not only avoids more expensive manufacturing and assembly procedures, but more importantly lends the drives the strength and durability of a solid, one-piece tool. Alternatively, however, especially in order to accommodate certain types of torquing mechanisms, drives 20 and 22 may be separate pieces, assembled as is known in the art to form a single tool drive.

The adjacent drives 20 and 22 are separated by a shoulder indicated in FIG. 1 as shoulder 28 (not to scale). In the preferred embodiment where drives 20 and 22 are integral, shoulder 28 may also be formed of the same piece. As is well known in the art, shoulder 28 should be shaped such that a socket or other tool bit or extension being engaged by drive 22 can be firmly seated on drive 22. In tools such as socket wrenches, where generally relatively little force is exerted in a direction along the vertical axis of the tool driver as depicted in FIG. 1, shoulder 28 should be shaped so as to simply aid in ensuring that a drive engaging tool or bit is adequately engaged with drive 22. In other tools, such as a nut driver, for example, shoulder 28 may be shaped with a substantially flat surface in a place normal to the axis of the tool driver so as to assist in bearing the force exerted along the axis.

Between head 16 and drive 20 may also be a second shoulder as indicated at 30. Where head 16 and tool driver 18 are built integrally, second shoulder 30 should be shaped in accordance with the considerations stated above with respect to shoulder 28. Where the torquing mechanism is also a ratchet mechanism, for example, second shoulder 30 may be formed between drive 20 and part of the ratchet mechanism. In constructions where tool driver 18 is manufactured as a piece separately made and later connected to the torquing mechanism, second shoulder 30 will be absent.

As stated, tool driver 18 may be an integral part of the torquing mechanism or releasably attachable thereto. An extension driver, often used to reach relatively inaccessible parts, is typically releasably attachable. Also as stated above, the torquing mechanism can be of any known kind. The torquing mechanism may simply be a handle or may be a more sophisticated mechanism such as a ratchet or a hydraulically or motor driven connection. The torquing mechanism may be, or be part of, a hand tool or may be part of a computer-controlled robotic tool.

Drives 20 and 22, or either of them, are provided with, respectively, detents 24 and 26 in a preferred embodiment of the invention. Detents are well known to those of skill in the art. In the simplest form, detents are simple protrusions from a surface of, for example, drive 20. The detent improves the frictional engagement between an engaging piece or bit and the drive, or can serve to positively engage a bit to retain it securely on the drive.

Figure 3:
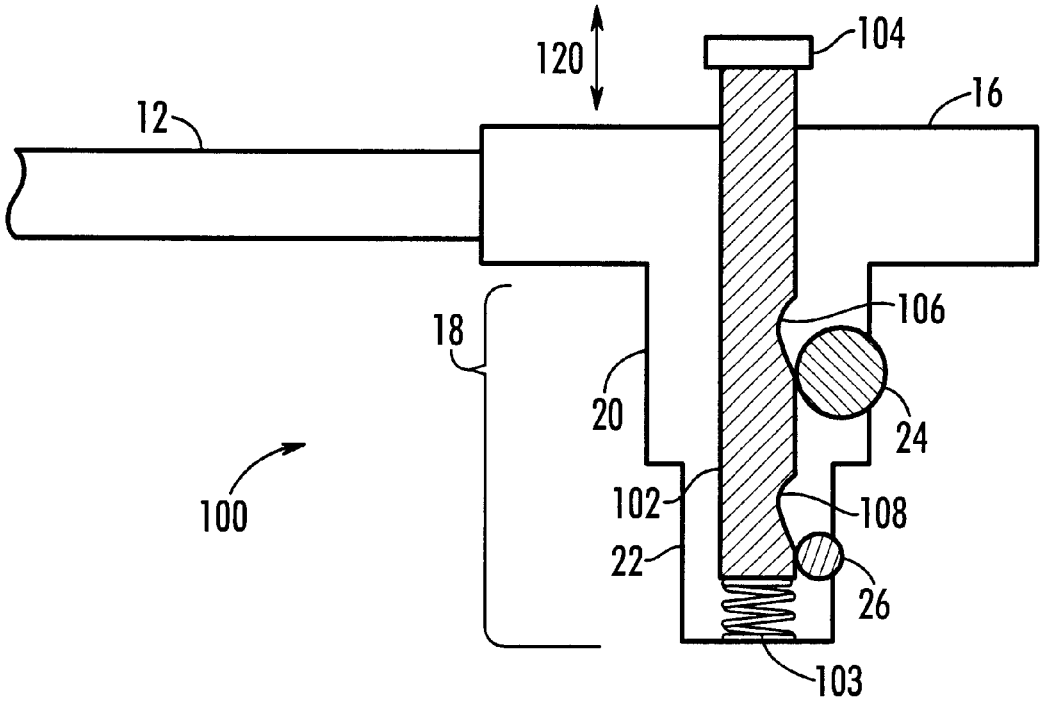
FIG. 3 is a diagrammatic illustration of a preferred embodiment of a cam mechanism for use with a tool driver according to the current invention.

A detent, such as detent 26, can also take more complex forms. An example of one such form is shown in FIG. 3. Similar reference numbers in the figure refer to elements discussed above with reference to FIG. 1. Thus in FIG. 3 is shown a tool handle 12 and a head 16. In the preferred embodiment, head 16 houses a ratchet drive, but it need not. Drives 20 and 22 form tool driver 18. Drives 20 and 22 are respectively provided with detents 24 and 26. Detents 24 and 26 in this embodiment take the form of spheres such as ball bearings. Each detent protrudes axially outwardly through respective holes in drives 20 and 22. The holes are large enough to allow movement of the detents, but too small for the detents to pass through. Tool driver 18 is formed with a hollow core into which a mechanism such as cam 102 is slidably placed. As is well-known in the art, cam 102 may be provided with recesses 106 and 108. Cam 102 may be moved to one position such that recesses 106 and 108 are aligned with detents 24 and 26 respectively. In this position, detents 24 and 26 can be moved or will simply fall to rest in the recesses. When cam 102 is moved to a second position whereby recesses 106 and 108 are not aligned with detents 24 and 26, the detents are urged radially outward from the respective drives. The direction of movement of cam 102 is shown by double-headed arrow 120, reflecting reciprocal movement, and cam 102 may be moved from a first position to a second position by means of a button 104, which is linked with cam 102. In a preferred embodiment, cam 102 is normally biased toward the described second position wherein the detents are urged outwardly. This bias will keep the respective detent engaged with the tool bit while freeing the user to use the tool. Any known biasing means can be used, an example being spring 103 shown in FIG. 3.

In operation, cam 102 is positioned so as to not urge the detents radially outward to protrude from the drives 20 and 22. A bit, socket, or other drive engaging piece is then engaged on the respective drive, whereafter cam 102 is moved to a first position, shown in FIG. 3, whereby recesses 106 and 108 are not aligned with respective detents 24 and 26. Detents 24 and 26 are urged radially outward of the respective drives 20 and 22 when cam 102 is so positioned. This outward urging enables detents 24 and 26 to aid in frictionally securing a tool bit to a drive.

Alternatively, the engaging portion of, for example, a tool bit may have a depression or groove therein substantially complementary to one of detents 24 and 26 whereby, when the detent is urged outwardly of the drive, the detent engages the groove or depression. When it is desired to disengage the tool bit, cam 102 is moved into its second position again, whereby the detents are not urged outwardly, and the tool bit is easily removed from the drive. It is usually convenient to bias cam 102, by means of a spring or other biasing mechanism, such that it is normally in the first position, that is, in position to urge the detents outward to engage the selected bit. The user then needs to move cam 102 only when it is desired to change bits.

Figure 4:
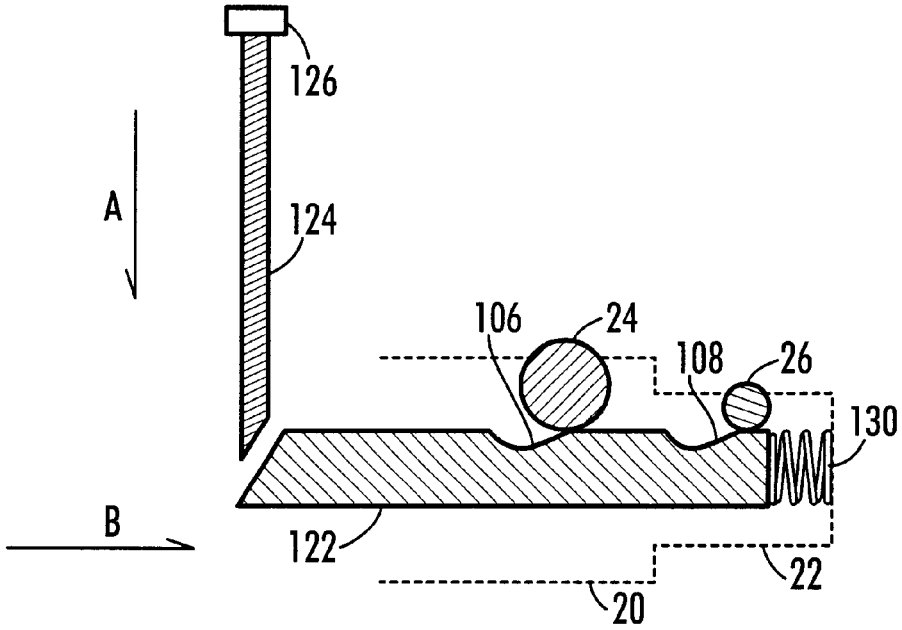
FIG. 4 is a diagrammatic illustration of the cam mechanism shown in FIG. 3.

An alternative means of urging the detents outwardly to protrude to aid in engaging a tool bit is shown in FIG. 4. Shown with the tool driver in outline form only, detents 24 and 26 with respective recesses 106 and 108 as described above are shown. Cam 122 can be positioned in a first position whereby detents 24 and 26 are urged outwardly and in a second position where they are not. Cam 122 is movable through cam lever 124. Cam lever 124 can be activated by another rod or device (not shown) or by a user-operated button 126. Button 126 is positioned to extend radially from the hollow core. Cam 122 and cam lever 124 meet in an angled sliding contact. Because the contact occurs within the driver or tool, lubrication can be provided. Alternatively, the contacting surfaces can be made with a durable substance such as nylon, requiring little or no other lubrication.

When cam lever 124 is moved downwardly in the direction of arrow A, cam 122 is forced in the direction of arrow B. Both motions are reciprocal such that cam 122 can assume a second position when force on cam lever 124 is relaxed. As described with reference to cam 102 in FIG. 3, cam 122 can be biased by a spring 130, or other biasing mechanism, so as to normally be in a position to urge detents 24 and 26 radially outward in an engaging position. Alternatively, a biasing mechanism (not shown) can be associated with cam lever 124 to perform the same function.

The means for moving cam 102 in FIG. 3 or cam 122 in FIG. 4 are illustrative only. There are many ways known in the art to bias or free the detents as desired. A simple method is to use a spring means to bias the detent outwardly at all times. The detent will aid in engaging a tool bit, but will be elastically forced inward to allow engagement or disengagement of a tool bit.

Moreover, cam 102 of FIG. 3 or cam 122 of FIG. 4 may be constructed other than as urging, or not urging, the detents simultaneously. That is, the recesses may be spaced such that, when detent 24 is urged outwardly, detent 26 is not, and vice versa. Similarly, the cam may have multiple positions and multiple recesses such that the detents may be urged outwardly at the same time or alternatingly, with an additional position in which neither is being urged outwardly.

Figure 2:
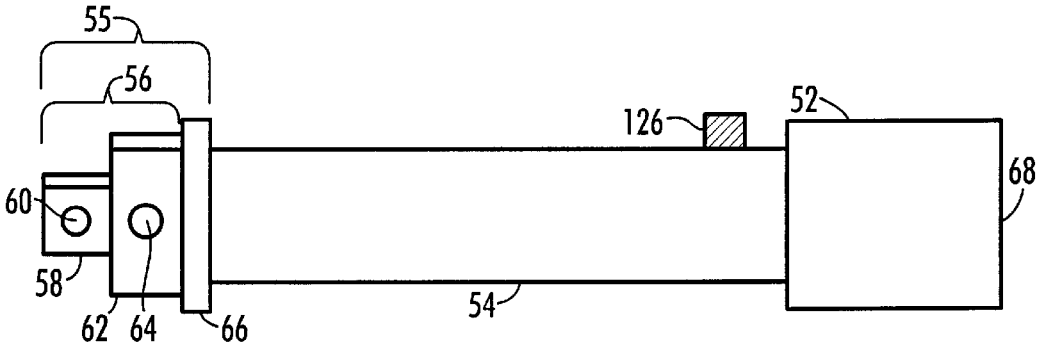
FIG. 2 is a diagrammatic illustration of the tool driver of the current invention which may be used as an adaptor and which can be releasably attached to a torquing mechanism.

An alternative preferred embodiment of the invention is shown in FIG. 2. In this embodiment, the tool driver 50 may function as an adaptor or extension for a tool. In this embodiment there is a shaft 54 of a desired predetermined length. Shaft 54 has a first end indicated at 52 and a second end 55. First end 52 may be operatively connected or part of a torquing mechanism (not shown) The connection may be intended as permanent, or may be a releasable connection. At the second end of shaft 54 is shown tool driver 56 with drives 58 and 62. Each drive 58 and 62 may have a respective detent 60 and 64.

A tool bit engaged by driver 58 is prevented from slipping up over shaft 54 by drive 62. A tool bit engaged by driver 62 must be also prevented from slipping up over shaft 54. To prevent this, a collar 66 may be provided. Collar 66 is preferably formed integrally with shaft 54, and may take the form of a simple widening of all or a portion of shaft 54. Alternatively, collar 66 may be specially formed or separately manufactured.

Shaft 54 may be formed with a hollow core (not shown) whereby a shaft such as cam 102 of FIG. 3 may be inserted to bias detents 64 and 60. The cam 102 and the hollow core may communicate with means to shift the position of cam 102 through an opening in first end 52 at a location 68.

The tool driver 50 illustrated in FIG. 2 may also be equipped with a detent mechanism as shown in FIG. 4. Shaft 54 is provided with a hollow core as above, in which cam 122 is positioned. A radial hole (not shown) may be provided in shaft 54 through which cam lever 122 extends. Cam lever 122 may be disposed at any point along shaft 54 that is desired and mechanically feasible. Preferably cam lever 122 and the radial hole in shaft 54 through which it extends is positioned adjacent to first end 52 such that button 126 does not increase the effective diameter of shaft 54.

An advantage of using a detent mechanism such as is illustrated in FIG. 4, whether incorporated into a driver or driver extension according to the invention, is that it provides for a releasable detents regardless of the torquing mechanism selected. The torquing mechanisms need not be adapted to engage a cam. Thus, torquing mechanisms may be simpler in the absence of additional moving parts, and the drivers of the invention more universally useful with varying torquing mechanisms.

While the exact shape and dimensions of the tool driver of the current invention are naturally dependent on the type of tool and torquing mechanisms with which they are to be used, the tool driver can be dimensioned such that current tool bits may be used. In the case of a socket wrench, when the larger of the two drives is in use, the smaller will extend into the bit beyond the engaging means in the bit. Because bits such as sockets are hollow, this will not interfere with the action of the tool bit. A prototype, wherein the individual drives of the tool driver were dimensioned to match current drivers, demonstrated this. In the case of tool such as a wrench, each drive may be dimensioned such that the drives do not extend too far within the bit. Because the force exerted on the bit is not diminished by such a shortening, the torquing strength is also not diminished.

Because of the large array of tools, bits, and uses, numerous alternatives are available, and numerous adaptations to the claimed invention may be made without departing from the scope thereof. Use of the claimed invention provides the advantages of speed and convenience without the need for complex, expensive mechanisms and without loss of strength and durability. The scope of the invention is as broad as is encompassed by the following claims.

What is claimed is:

1. A tool driver for use with a torquing mechanism, said driver comprising:

a shaft having a predetermined length, a first end, and a second end, and a hollow core extending axially therein;

said first end operatively connected to said torquing mechanism and having an axial opening communicating with said hollow core;

said second end having a first drive terminal to said second end and a second drive adjacent said first drive;

said first drive having a predetermined first cross-sectional dimension whereby said first drive can releasably engage any one of a first set of standard tool bits, said first drive further comprising a first detent protruding from said first drive capable of frictionally engaging a bit of said first set of standard tool bits, said first detent being in communication with said hollow core; and said second drive having a predetermined second cross-sectional dimension whereby said second drive can releasably engage any one of a second set of standard tool bits, said second drive further comprising a second detent protruding from said second drive capable of frictionally engaging a bit of said second set of standard tool bits, said second detent being in communication with said hollow core;

a cam positioned in said hollow core, said cam capable of being moved between a first position and a second position whereby when said cam is in said first position said first and second detents are urged in a direction radially outward from said shaft and when said cam is in said second position said first and second detents are not urged in said direction, wherein said cam is moved between said first position and said second position by a cam lever extending radially from said hollow core; and wherein said first cross-sectional dimension is not equal to said second cross-sectional dimension.

2. The tool according to claim 1, wherein said first drive and said second drive each further comprise a detent.

* * * * *